US009816456B2

(12) United States Patent
Bucher et al.

(10) Patent No.: US 9,816,456 B2
(45) Date of Patent: Nov. 14, 2017

(54) CYLINDER LINER

(71) Applicant: Mahle International GmbH, Stuttgart (DE)

(72) Inventors: Gerhard Bucher, Eppingen (DE); Stefan Gaiselmann, Stuttgart (DE); Marco Maurizi, Stuttgart (DE)

(73) Assignee: Mahle International GmbH (DE)

( * ) Notice: Subject to any disclaimer, the term of this patent is extended or adjusted under 35 U.S.C. 154(b) by 299 days.

(21) Appl. No.: 14/412,940

(22) PCT Filed: Jul. 5, 2013

(86) PCT No.: PCT/EP2013/064296
§ 371 (c)(1),
(2) Date: Jan. 5, 2015

(87) PCT Pub. No.: WO2014/006199
PCT Pub. Date: Jan. 9, 2014

(65) Prior Publication Data

US 2015/0152806 A1 Jun. 4, 2015

(30) Foreign Application Priority Data

Jul. 6, 2012 (DE) ..... 10 2012 211 866

(51) Int. Cl.
*F02F 1/00* (2006.01)
*B22D 19/00* (2006.01)
(Continued)

(52) U.S. Cl.
CPC ..... *F02F 1/004* (2013.01); *B22D 19/0009* (2013.01); *B22D 19/02* (2013.01);
(Continued)

(58) Field of Classification Search
CPC ..... F02F 1/004; F02F 7/0021; B22D 19/04; B22D 19/02; F22D 19/0009
See application file for complete search history.

(56) References Cited

U.S. PATENT DOCUMENTS 4,546,048 A 10/1985 Guenther
6,044,821 A 4/2000 Weng
(Continued)

FOREIGN PATENT DOCUMENTS

DE 3134771 A1 3/1983
DE 3507601 A1 9/1985
(Continued)

OTHER PUBLICATIONS

English abstract for JP61-180633.
(Continued)

*Primary Examiner* — Jacob Amick
(74) *Attorney, Agent, or Firm* — Fishman Stewart PLLC

(57) ABSTRACT

A cylinder liner for an internal combustion engine may include an outer circumferential surface defined by the cylinder liner composed of a gray cast iron for integrally casting onto a cast material of an engine block. A bonding component may be included for strengthening a bond of the outer circumferential surface to the cast material of the engine block. The bonding component may include at least one of a wire mesh and a wire grid that does not melt during a casting operation of the engine block. The bonding component may be arranged at least in a predefined region on the outer circumferential surface. The bonding component may be welded at least partially to the outer circumferential surface.

20 Claims, 1 Drawing Sheet

(51) Int. Cl.
*B22D 19/04* (2006.01)
*B22D 19/02* (2006.01)
*F02F 7/00* (2006.01)

(52) U.S. Cl.
CPC ..... *B22D 19/04* (2013.01); *F02F 7/0021* (2013.01); *F02F 2200/00* (2013.01)

(56) References Cited

U.S. PATENT DOCUMENTS

| | | | | |
|---|---|---|---|---|
| 6,082,436 | A | 7/2000 | Divecha et al. | |
| 6,123,052 | A * | 9/2000 | Jahn ..... | B22D 19/0081 123/193.2 |
| 6,182,629 | B1 | 2/2001 | Gobbels et al. | |
| 2005/0025894 | A1 | 2/2005 | Ren et al. | |
| 2014/0102401 | A1 | 4/2014 | Issler | |

FOREIGN PATENT DOCUMENTS

| | | | | |
|---|---|---|---|---|
| DE | 19845347 | C1 | 3/2000 | |
| DE | 19859098 | C1 * | 3/2000 | ..... B22D 19/0009 |
| DE | 19859098 | C1 | 3/2000 | |
| DE | 10026290 | A1 | 11/2001 | |
| DE | 10235910 | A1 | 2/2004 | |
| DE | 10324030 | A1 | 12/2004 | |
| DE | 102004005458 | A1 | 9/2005 | |
| DE | 102006021176 | A1 | 11/2007 | |
| DE | 102011102203 | A1 | 11/2012 | |
| EP | 2151568 | A2 | 2/2010 | |
| GB | 601894 | A | 5/1948 | |
| JP | 60-29445 | | 2/1985 | |
| JP | 61-155646 | | 7/1986 | |
| JP | 61-180633 | | 8/1986 | |
| JP | 54-59661 | B2 | 4/2014 | |
| WO | WO-2011/011488 | A1 | 1/2011 | |

OTHER PUBLICATIONS

English abstract for JP61-155646.
English abstract for DE-3134771.
English abstract for DE-19859098.
English abstract for DE-102006021176.
English abstract for DE-102004005458.
English abstract for DE-10026290.
English abstract for DE-10324030.
English abstract DE-10235910.
English abstract for JP60-029445.
English abstract for JP54-59661.

* cited by examiner

CYLINDER LINER

CROSS-REFERENCE TO RELATED APPLICATIONS

This application claims priority to German Patent Application No. 10 2012 211 866.7, filed Jul. 6, 2012, and International Patent Application No. PCT/EP2013/064296, filed Jul. 5, 2013, both of which are hereby incorporated by reference in their entirety.

TECHNICAL FIELD

The present invention relates to a cylinder liner of gray cast iron for integrally casting into an engine block of an internal combustion engine according to the preamble of claim 1. The invention also relates to an engine block fitted with at least one such cylinder liner and to a method for producing such an engine block.

BACKGROUND

DE 198 59 098 C1 discloses a cylinder liner of the generic type of gray cast iron for integrally casting into an engine block consisting of cast light metal of an internal combustion engine. A means designed for strengthening the bond of the gray cast iron of the cylinder liner to the cast light metal of the engine block is provided at least on the outer lateral surface of the cylinder liner. The means is formed here by a metallic semifinished product that encloses the outer lateral surface, does not melt during the casting operation and is designed in such a way that on the outer lateral surface there are formed free zones that are not covered by the semifinished product. The described connection between the cylinder liner and the engine block is also intended to have the effect of reducing the risk of undesired crack formation between the cylinder liner and the engine block.

DE 10 2006 021 176 A1 discloses a crankcase for an internal combustion engine with a cylindrical tube of a light metal, on the running surface of which a piston is guided. Integrally cast into the cylindrical tube is a strengthening part, which comprises a knitted-gauze or grid structure and extends over virtually the entire height of the cylindrical tube. It is intended in particular to avoid undesired deformation of the cylindrical tube over the entire running height of the piston.

DE 100 26 290 B4 discloses a method for producing a cylinder crankcase for an internal combustion engine, a main body consisting of a first material and cylinder walls consisting of a second material, and a grid-like reinforcement being provided between the two materials. The grid-like reinforcement is in this case placed into a casting mold for the cylinder crankcase, whereupon the two materials are then introduced into the casting mold. It is intended in this way that an internal combustion engine with an easily machinable main body and wear-resistant cylinder running surfaces can be produced easily and at low cost.

DE 10 2004 005 458 B4 discloses a lining-free cylinder block of a light metal alloy cast in a metallic permanent mold for an internal combustion engine and having a locally strengthened cylinder running surface, the local strengthening being formed by a separate molded part. The separate molded part is in this case formed by a liner of one or more layers that is formed by wound-on wire.

DE 31 34 771 A1 discloses a cylinder liner for internal combustion engines which, to even out the radial thermal expansion, is surrounded by a covering that undergoes lower thermal expansion in the radial direction than the cylinder liner, the repression of the expansion caused by the covering varying over the length of the cylinder liner and the covering consisting of a fiber composite material. In this way it is intended to provide a cylinder liner that has a constant thermal radial expansion over its longitudinal axis that is in particular adapted to the radial expansion of a piston.

Further internal combustion engines with cylinder liners are disclosed for example by JP 61155646 A, JP 61180633 A and GB 601,894.

SUMMARY

The present invention is concerned with the problem of providing an improved embodiment for a cylinder liner of the generic type that is distinguished in particular by an improved connection between the cylinder liner and a cast engine block. The invention is additionally concerned with the problem of providing an improved method for producing an internal combustion engine with at least one such cylinder liner.

This problem is solved according to the invention by the subjects of the independent claims. Advantageous embodiments are the subject of the dependent claims.

The present invention is based on the general concept of providing a cylinder liner of gray cast iron at least in certain regions on its outer circumferential surface, that is to say on its outer lateral surface, with a means for strengthening the bond of the cylinder liner to the cast material of an engine block and welding this means at least in certain regions to the cylinder liner. The means is formed here as a wire mesh or wire grid that does not melt during the casting operation of the engine block and is preferably welded to the cylinder liner by way of welding spots. Particularly at the welding spots connecting the means, that is to say the wire mesh or the wire grid, to the cylinder liner, there form undercuts, which during the later encapsulation of the cylinder liner placed into a casting mold of the engine block are encapsulated by the casting material of the engine block, and in this way a particularly high bonding force between the cylinder liner and the engine block is produced. With the wire grid or wire mesh arranged on the outer circumferential surface, there can consequently be much improved anchoring of the cylinder liner in the cast material of the engine block, and also improved heat flow between the cylinder liner and the engine block, whereby the cylinder liner can also be cooled better and, because of this fact, under some circumstances can be arranged at a greatly reduced distance from the adjacent cylinder liner. A closer arrangement of the individual cylinders makes it possible in particular to build the engine smaller and more compact, and as a result also much lighter, which in turn brings with it advantages regarding the fuel consumption of the internal combustion engine, in particular if it is used in a motor vehicle.

In the case of an advantageous development of the solution according to the invention, the means is stretched over the outer circumferential surface of the cylinder liner. The means, that is to say therefore the wire mesh or the wire grid, is consequently first firmly attached at a starting edge to the cylinder liner by way of corresponding welding spots, whereupon the wire mesh or the wire grid is then stretched over the circumference, that is to say over the outer lateral surface, of the cylinder liner. In this stretched state, further welding spots for connecting the means to the cylinder liner are then arranged up to a respective ending edge of the means. In this case, the means, that is to say therefore the wire mesh or the wire grid, may enclose the cylinder liner over the entire outer circumferential surface or else be arranged only in the manner of a segment of a circle, for example over 90° in each case. By being stretched, the means bears against the outer lateral surface of the cylinder liner with a high pressing force, whereby optimal anchoring of the cylinder liner in the cast material of the engine block away from the actual welding spots can also be achieved.

The individual welding spots of the spot-welded connection are expediently arranged linearly, in particular in the axial direction of the cylinder liner. The individual welding spots are consequently preferably arranged one behind the other in the axial direction from a first longitudinal end up to an opposite second longitudinal end, the welding spot lines that are formed by the welding spots being provided at least at a starting edge and an ending edge of the wire mesh or the wire grid. It is of course also conceivable that at least four, preferably even eight or more, welding spot lines are provided, spaced apart from one another in the circumferential direction and aligned in the axial direction of the cylinder liner. The more welding spots or welding spot lines are provided here, the more undercuts that are flowed around by the later cast material of the engine block, and thereby form a solid undercut connection, can be formed. Apart from the described welding spot lines extending in the axial direction, welding spot lines arranged obliquely to the axis of the cylinder liner or just individual welding spots are of course also conceivable. However, the welding spot lines extending in the axial direction offer the advantage that the wire mesh or the wire grid can be stretched uniformly in the circumferential direction over the outer lateral surface of the cylinder liner and, as a result of the individual welding spot lines, the tensioning in the portions of the wire grid or wire mesh that lie in between extends in a uniformly distributed manner.

In the case of an advantageous development of the solution according to the invention, the engine block is produced from a light metal, in particular from aluminum. The use of light metal makes a considerable weight saving possible, which has advantageous effects on fuel consumption, in particular when such an engine block is used in a motor vehicle.

Further important features and advantages of the invention emerge from the subclaims, from the drawings and from the associated description of the figures on the basis of the drawings.

It goes without saying that the features mentioned above and still to be explained below can be used not only in the combination respectively specified, but also in other combinations or on their own without departing from the scope of the present invention.

Preferred exemplary embodiments of the invention are represented in the drawings and are explained in more detail in the description that follows, the same reference numerals referring to components that are the same or similar or are functionally the same.

DETAILED DESCRIPTION

Figure 1:
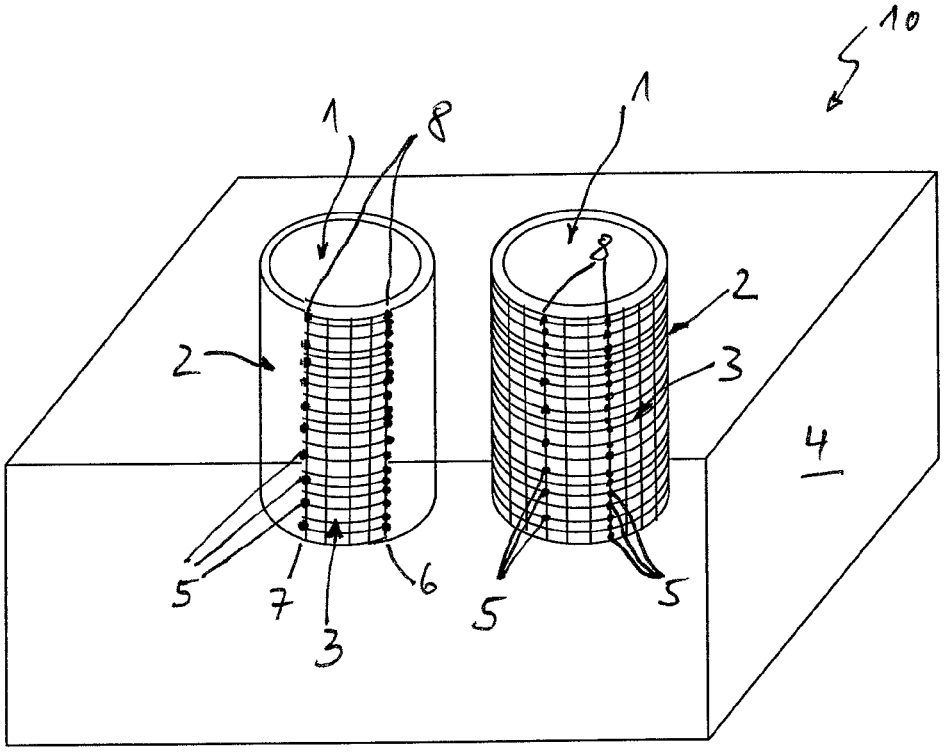
FIG. 1 schematically shows two cylinder liners formed according to the invention in an engine block, FIG. 2 schematically shows a sectional representation in the region of a welding spot connecting a wire mesh to the cylinder liner, FIG. 3 schematically shows individual method steps of a method for producing an internal combustion engine.

As shown in FIG. 1, a cylinder liner 1 according to the invention has at least in certain regions on an outer circumferential surface 2 a means 3 for strengthening the bond of the cylinder liner 1 to a cast material of an engine block 4. The means 3 is formed here as a wire mesh or wire grid that does not melt during the casting operation of the engine block 4 and preferably consists of steel. A connection of the means 3 to the outer lateral surface 2 of the cylinder liner 1 takes place in this case by way of a welded connection, in particular by way of a number of welding spots 5. The means 3, that is to say the wire mesh or the wire grid, is also stretched over the outer circumferential surface 2 of the cylinder liner 1, whereby close bearing or pressing of the means 3 against the cylinder liner 1 alongside the welding spots 5 can also be achieved. As can be seen from FIG. 1, the means 3 may surround the outer lateral surface 2 of the cylinder liner 1 over its full circumference (compare the cylinder liner on the right in FIG. 1) or else only be provided partially (compare the cylinder liner on the left in FIG. 1).

The individual welding spots 5 of the spot-welded connection are preferably formed linearly here, in particular in the axial direction of the cylinder liner 1, as represented for example in particular in the case of the cylinder liner as shown on the left in FIG. 1. In addition, the individual welding spots 5 of the spot-welded connection are preferably provided at crossing points of the individual wires of the wire mesh or the wire grid, that is to say of the means 3. If the outer lateral surface 2 of the cylinder liner 1 is only partially provided with the means 3, that is to say with the wire mesh or the wire grid, the welding spots 5 are preferably arranged along a starting edge 6 and an ending edge 7, whereby optimal stretching of the means 3 between the two edges 6, 7, and consequently close bearing of the means 3 against the outer lateral surface 2 of the cylinder liner 1 between the two edges 6 and 7, can be achieved. Along the starting edge 6 and along the ending edge 7, the welding spots 5 are arranged here in the axial direction of the cylinder liner 1, and thereby form what are known as welding spot lines 8. In the case of a means 3 that covers the outer lateral surface 2 more than just partially, a number of such welding spot lines 8, distributed in the circumferential direction, may be provided on the outer lateral surface 2, at least 4, preferably 8, welding spot lines 8 being arranged in the axial direction of the cylinder liner 1. Along the individual welding spot lines 8, all of the crossing points of the wires of the wire mesh or wire grid may be welded here to the cylinder liner 1, while it is also conceivable that only every second or third crossing point is welded on.

Apart from a strictly axial alignment of the individual welding spot lines 8, an oblique alignment of the welding spot lines 8 or else an arbitrary punctiform welding of the means 3 onto the cylinder liner 1 is of course also conceivable. However, the welding spot lines 8 extending in the axial direction offer the advantage that the tensioning of the means 3 between two adjacent welding spot lines is equal, since the distance between the individual welding spots 5 of two adjacent welding spot lines 8 is always equal.

After arranging and securely welding the means 3 on the outer lateral surface 2, the cylinder liner 1 according to the invention is placed into a casting mold for casting the engine block 4, the cylinder liner 1 subsequently being encapsulated by the cast material of the engine block 4, for example a light metal, in particular aluminum. Undercuts 9 (compare FIG. 2) thereby form at the welding spots 5, making a particularly secure connection and particularly secure anchoring of the cylinder liner 1 in the cast material of the engine block 4 possible. A better thermal bond of the cylinder liner 1 to the engine block 4 is also achieved by the means 3, that is to say by the wire mesh or by the wire grid, whereby the individual cylinders can be cooled better and, in particular, a distance between two cylinder liners 1, that is to say between two cylinders, can be reduced, whereby the production of a particularly compact, small and therefore also lightweight engine block 4 can be realized. Such a compact engine block 4 in turn allows the weight of an internal combustion engine 10 fitted with it to be reduced, which leads to a not inconsiderable fuel saving when such an internal combustion engine 10 is used in a motor vehicle.

Figure 2:
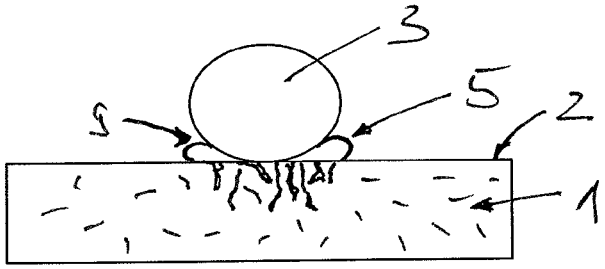
Figure 3:
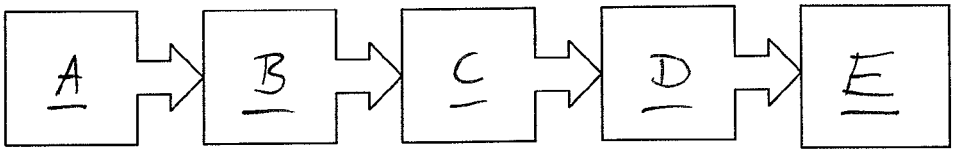

As shown in FIG. 3, a method according to the invention for producing the engine block 4 or the internal combustion engine 10 with such an engine block 4 is now described. In this case, firstly, in a method step A, a cylinder liner 1 of gray cast iron is provided at least in certain regions on its outer circumferential surface 2 with a wire mesh or a wire grid, that is to say a means 3 for strengthening the bond of the cylinder liner 1 to a cast material of the engine block 4. In method step B, this means 3 is subsequently stretched over the outer circumferential surface 2 of the cylinder liner 1. In method step C, the means 3 is welded at least in certain regions to the cylinder liner 1, for example by way of welding spots 5 arranged along the welding spot lines 8, as represented by FIGS. 1 and 2. In method step D, the cylinder liner 1 is then placed together with the means 3 welded thereto into a casting mold for an engine block 4, whereupon, in method step E, the casting mold is subsequently filled with a light metal alloy, in particular with an aluminum alloy, and the engine block 4 is thereby produced while at the same time integrally casting the cylinder liner(s) 1.

With the method according to the invention and with the engine block 4 according to the invention, a much closer arrangement of the individual cylinder liners 1, and as a consequence a much closer arrangement of the individual cylinders in the engine block 4, can be achieved, whereby the engine block can be built smaller, and in particular also lighter. During the casting of the engine block 4, the undercuts 9 that are formed particularly at the welding spots 5 are encapsulated by the cast material of the engine block, and thus produce an extremely secure connection between the cylinder liner 1 and the engine block 4. The close bond of the cylinder liner 1 to the engine block 4 also has the effect in particular of avoiding air gaps between these components 1, 4, which may lead to reduced heat transmission, whereby better cooling and at the same time also a closer arrangement of the individual cylinders are made possible.

The invention claimed is:

1. A cylinder liner for an internal combustion engine, comprising: an outer circumferential surface defined by the cylinder liner composed of a gray cast iron for integrally casting into a cast material of an engine block, a bonding component for strengthening a bond of the outer circumferential surface to the cast material of the engine block, the bonding component including at least one of a wire mesh and a wire grid that does not melt during a casting operation of the engine block, the bonding component being arranged at least in a predefined region on the outer circumferential surface, wherein the bonding component is welded in at least one region to the outer circumferential surface along a welded connection.

2. The cylinder liner as claimed in claim 1, wherein at least one of:

the bonding component has a higher melting point than the cast material of the engine block, and the bonding component is made of steel.

3. The cylinder liner as claimed in claim 1, wherein the bonding component is stretched over the outer circumferential surface.

4. The cylinder liner as claimed in claim 1, wherein the welded connection includes a plurality of welding spots securing the bonding component and the outer circumferential surface together.

5. The cylinder liner as claimed in claim 4, wherein the individual welding spots of the plurality of welding spots are arranged linearly.

6. The cylinder liner as claimed in claim 5, wherein the plurality of welding spots define at least four welding spot lines arranged distributed over a circumference of the outer circumferential surface.

7. The cylinder liner as claimed in claim 4, wherein the individual welding spots of the plurality of welding spots are provided at crossing points of individual wires of the at least one of the wire mesh and the wire grid.

8. The cylinder liner as claimed in claim 1, wherein the cast material of the engine block is composed of a light metal.

9. An engine block for an internal combustion engine, comprising:

an integrally cast cylinder liner composed of a gray cast iron defining an outer circumferential surface, wherein the cylinder liner is arranged in a cast material;

a bonding component disposed between the outer circumferential surface and the cast material and extending at least in part peripherally around the outer circumferential surface, the bonding component having a melting point higher than a melting point of the cast material, wherein the bonding component includes at least one of a wire mesh and a wire grid;

wherein the bonding component is connected to the outer circumferential surface via a spot-welded connection, the spot-welded connection including a plurality of welded spots arranged along an axial direction of the cylinder liner to define at least two axially extending welded spot lines distributed circumferentially around the outer circumferential surface.

10. A method for producing an engine block for an internal combustion engine comprising:

preparing a cylinder liner of a gray cast iron defining an outer circumferential surface for casting into a cast material, and positioning a bonding component at least in a predefined region on the outer circumferential surface wherein the bonding component includes at least one of a wire mesh and a wire grid for strengthening a bond of the cylinder liner to the cast material, stretching the bonding component over the outer circumferential surface of the cylinder liner, welding the bonding component to the outer circumferential surface of the cylinder liner via a plurality of weld spots, positioning the cylinder liner together with the bonding component into a casting mold of the casting material, filling the casting mold with a light metal alloy thereby producing the engine block while at the same time integrally casting the cylinder liner.

11. The engine block as claimed in claim 9, wherein the bonding component is composed of steel.

12. The engine block as claimed in claim 9, wherein the bonding component is stretched over the entire outer circumferential surface of the cylinder liner.

13. The engine block as claimed in claim 9, wherein the plurality of welded spots respectively define an undercut between the bonding component and the outer circumferential surface to facilitate anchoring the cylinder liner in the cast material.

14. The engine block as claimed in claim 9, wherein the cast material is composed of a light metal.

15. The cylinder liner as claimed in claim 2, wherein the cast material is composed of at least one of aluminium and an aluminium alloy.

16. The cylinder liner as claimed in claim 4, wherein the plurality of welding spots are arranged in an axial direction of the outer circumferential surface.

17. The cylinder liner as claimed in claim 4, wherein the respective welding spots define at least one linear welding spot line extending in an axial direction of the outer circumferential surface.

18. The cylinder liner as claimed in claim 4, wherein the plurality of welding spots respectively define an undercut disposed between the bonding component and the outer circumferential surface to facilitate anchoring the cast material at the welded connection.

19. The method as claimed in claim 10, wherein welding the bonding component to the outer circumferential surface includes forming an undercut at the plurality of weld spots between the bonding component and the outer circumferential surface to facilitate anchoring the cylinder liner in the cast material.

20. The method as claimed in claim 10, wherein welding the bonding component to the outer circumferential surface includes forming a weld spot line by arranging the plurality of weld spots linearly with respect to one another at least one of along an axial direction of the cylinder liner and obliquely to a longitudinal axis of the cylinder liner.

* * * * *